US005597072A

United States Patent [19]

Lieberman et al.

[11] Patent Number: 5,597,072

[45] Date of Patent: Jan. 28, 1997

[54] TOTALLY INTERACTIVE PATIENT COMPLIANCE METHOD

[75] Inventors: Robert E. Lieberman, Morris Township; Jacques Krasny, Morristown; Ian R. Ferrier, Morris Township, all of N.J.

[73] Assignee: Bogart, Delafield, Ferrier Inc., Morristown, N.J.

[21] Appl. No.: 169,307

[22] Filed: Dec. 17, 1993

[51] Int. Cl.[6] ..... B65D 83/04; B42D 15/00

[52] U.S. Cl. ..... 206/534; 206/531; 206/538; 283/70

[58] Field of Search ..... 206/531, 534, 206/538, 539, 459.5; 283/70, 900

[56] References Cited

U.S. PATENT DOCUMENTS

| | | | |
|---|---|---|---|
| 3,942,641 | 3/1976 | Segre | 206/534 |
| 4,057,145 | 11/1977 | Wray et al. | 206/538 |
| 4,295,567 | 10/1981 | Knudsen | 206/534 |
| 4,534,468 | 8/1985 | Nuckols et al. | 206/534 |
| 4,905,388 | 3/1990 | Sinkow | 283/900 X |
| 4,958,736 | 9/1990 | Urheim | 206/531 |
| 4,976,351 | 12/1990 | Mangini et al. | 206/459.5 X |
| 5,105,949 | 4/1992 | Blair | 206/534 |

*Primary Examiner*—Bryon P. Gehman
*Attorney, Agent, or Firm*—Richard R. Muccino

[57] ABSTRACT

In one embodiment, the present invention is directed to a Medication Compliance Dispenser to help prevent drug abuse by a patient taking medicine which comprises a multicompartment container wherein (a) at least some of the compartments contain individual doses of the medicine and at least some of the compartments contain a placebo; (b) the compartments containing the medicine are known but unknown to the patient; (c) each compartment is labeled with a code to identify the compartment; (d) the container permits random access to each compartment and the dispersing of its contents; and (e) the Dispenser displays a telephone number which the patient must call to learn the code of a compartment which contains the medicine. In another embodiment, the present invention is directed to a Medication Compliance Dispenser to help a patient comply with taking a medicine which comprises a multicompartment container wherein (a) the compartments contain individual doses of the medicine; (b) the container permits sequential access to each compartment and dispensing of its contents; (c) upon a medicine being dispensed from a compartment, at least some of the compartments display a message to the patient to call a telephone number; and (d) the compartments containing the message are known but unknown to the patient; whereupon the timing of the patient's telephone call will signal whether the patient has complied with taking the medicine. This invention is also directed at a method for helping prevent drug abuse by a patient taking medicine and a method for helping a patient comply with taking a medicine in a Totally Interactive Patient Compliance Program.

2 Claims, 3 Drawing Sheets

Analgesic Model

Rx #: 1234
Dr. Jones
Mr. Smith

Card #: 12345
Call: 1-800-INTOUCH
for medication

| | A | B | C | D | E | F | G | H | I | J |
|---|---|---|---|---|---|---|---|---|---|---|
| 1 | o | o | o | o | o | o | o | o | o | o |
| 2 | o | o | o | o | o | o | o | o | o | o |
| 3 | o | o | o | o | o | o | o | o | o | o |
| 4 | o | o | o | o | o | o | o | o | o | o |
| 5 | o | o | o | o | o | o | o | o | o | o |
| 6 | o | o | o | o | o | o | o | o | o | o |
| 7 | o | o | o | o | o | o | o | o | o | o |
| 8 | o | o | o | o | o | o | o | o | o | o |
| 9 | o | o | o | o | o | o | o | o | o | o |
| 10 | o | o | o | o | o | o | o | o | o | o |

30 real
70 placebo
"Randomized"

FIGURE 1

TIPP
Totally Interactive
Patient Program

Physician ↔ Pharmacy ↔ Patient

- Prescribes TIPP Rx
- Reads reports
- Manages patient

- Fills Rx
- Logs patient in program
- Links TIPP Rx number with patient and informs physician via BRC or electronic mail

- Complies with program
- Reports on condition
- Follows physician management

↖↘ TIPP Center ↗↙

- Administers physician plan
- Collects patient information
- Reports to physician

FIGURE 2

Analgesic Model

Rx #: 1234
Dr. Jones
Mr. Smith

Card #: 12345
Call: 1-800-INTOUCH
for medication

| | A | B | C | D | E | F | G | H | I | J |
|---|---|---|---|---|---|---|---|---|---|---|
| 1 | o | o | o | o | o | o | o | o | o | o |
| 2 | o | o | o | o | o | o | o | o | o | o |
| 3 | o | o | o | o | o | o | o | o | o | o |
| 4 | o | o | o | o | o | o | o | o | o | o |
| 5 | o | o | o | o | o | o | o | o | o | o |
| 6 | o | o | o | o | o | o | o | o | o | o |
| 7 | o | o | o | o | o | o | o | o | o | o |
| 8 | o | o | o | o | o | o | o | o | o | o |
| 9 | o | o | o | o | o | o | o | o | o | o |
| 10 | o | o | o | o | o | o | o | o | o | o |

30 real
70 placebo
"Randomized"

FIGURE 3

Compliance Model

Rx #: 1234
Dr. Jones
Mr. Smith

Card #: 12345
TAKE IN SEQUENCE
If blue dot appears call
1-800-INTOUCH

| | | | | | |
|---|---|---|---|---|---|
| o | o | o | o | o | o |
| 1 | 2 | 3 | 4 | 5 | 6 |
| o | o | o | o | o | o |
| 7 | 8 | 9 | 10 | 11 | 12 |
| o | o | o | o | o | o |
| 13 | 14 | 15 | 16 | 17 | 18 |
| o | o | o | o | o | o |
| 19 | 20 | 21 | 22 | 23 | 24 |
| o | o | o | o | o | o |
| 25 | 26 | 27 | 28 | 29 | 30 |

TOTALLY INTERACTIVE PATIENT COMPLIANCE METHOD

FIELD OF THE INVENTION

This invention relates to a Totally Interactive Patient Compliance Program. Specifically, this invention relates to a compliance and interaction method designed to encourage compliance between patients and physicians and improve health care. This invention also relates to Medication Compliance Dispensers for use in conjunction with the Totally Interactive Patient Compliance Program.

BACKGROUND OF THE INVENTION

Non-compliance with a medication regimen is one of the most important problems facing patients and health care professionals. An important dimension of this non-compliance is the loss of positive medical outcome. In analyses such as the Helsinki Heart Study of over 4,000 patients, a direct correlation was found between non-compliance and unfavorable cholesterol levels. Moreover, there is virtually a linear relationship between unfavorable cholesterol levels and coronary risk. In chemotherapy, survival rates for patients who diligently maintain compliance of oral medication are markedly different compared to those who do not (50% versus 25% survival at 4 years). In the case of kidney organ transplant recipients, medical non-compliance directly affects the extent of graft loss.

On the economic side, non-compliance is dramatically expensive to the health care system. For example, 23% of United States nursing home admissions and 10% of hospital admissions are estimated to be a direct result of prescription drug non-compliance. Pro-rating this component of hospital and nursing home admissions against all other causes reveals that non-compliance leads to $45 billion of health care system utilization. Even after taking into account the incremental cost of medication in fully compliant patients, studies have shown that improving health care compliance has a cause benefit ratio as high as 14:1. Presumably, people do not set out to become non-compliant given the consequences of non-compliance. Rather, a busy life combined with normal human traits such as forgetting or denial of medical condition combine to create the phenomenon of noncompliance. While some compliance approaches to prescription medications have succeeded dramatically (e.g., birth control pill dispensers), most attempts at enforcing diligent compliance have failed.

SUMMARY OF THE INVENTION

In one embodiment, the present invention is directed to a Medication Compliance Dispenser, to help prevent drug abuse by a patient taking medicine, which comprises a multicompartment container wherein:

(a) at least some of the compartments contain individual doses of the medicine and at least some of the compartments contain a placebo;

(b) the compartments containing the medicine are known but unknown to the patient;

(c) each compartment is labeled with a code to identify the compartment;

(d) the container has means permitting random access to each compartment and the dispensing of its contents; and (e) the Dispenser displays a telephone number which the patient must call to learn the code of a compartment which contains the medicine.

In another embodiment, the present invention is directed to a Medication Compliance Dispenser, to help a patient comply with taking a medicine, which comprises a multicompartment container wherein:

(a) the compartments contain individual doses of the medicine;

(b) the container has means permitting sequential access to each compartment and dispensing of its contents:

(c) upon a medicine being dispensed from a compartment, at least some of the compartments display a message to the patient to call a telephone number; and (d) the compartments containing the message are known but unknown to the patient;

whereupon the timing of the patient's telephone call will signal whether the patient has complied with taking the medicine.

In yet another embodiment, the present invention is directed to a method for helping prevent drug abuse by a patient taking medicine in a Totally Interactive Patient Compliance Program which comprises the steps of:

(A) providing the patient with a Medication Compliance Dispenser having a multicompartment container wherein:

(a) at least some of the compartments contain individual doses of the medicine and at least some of the compartments contain a placebo;

(b) the compartments containing the medicine are known but unknown to the patient;

(c) each compartment is labeled with a code to identify the compartment;

(d) the container has meat is permitting random access to each compartment and the dispensing of its contents; and (e) the Dispenser displays a telephone number which the patient must call to learn the code of a compartment which contains the medicine; and (B) instructing the patient to call the telephone number to learn the code of a compartment in order to take the medicine.

In still yet another embodiment, the present invention is directed to a method for helping a patient comply with taking a medicine in a Totally Interactive Patient Compliance Program which comprises the steps of:

(A) providing the patient with a Medication Compliance Dispenser having a multicompartment container wherein:

(a) the compartments contain individual doses of the medicine;

(b) the container has means permitting sequential access to each compartment and dispensing of its contents;

(c) upon a medicine being dispensed from a compartment, at least some of the compartments display a message to the patient to call a telephone number; and (d) the compartments containing the message are known but unknown to the patient;

whereupon the timing of the patient's telephone call will signal whether the patient has complied with taking the medicine; and (B) instructing the patient to call the telephone number to signal whether the patient has complied with taking the medicine.

BRIEF DESCRIPTION OF THE FIGURES

FIG. 1 is a schematic diagram illustrating the Totally Interactive Patient Compliance Program and the relationship between the prescribing physician, the enrolled and trained pharmacist, the patient, and the Totally Interactive Patient Compliance Program Center.

FIG. 2 is an illustration of an Abuse Preventing Medication Compliance Dispenser useful for substances prone to abuse.

FIG. 3 is an illustration of a Medication Compliance Dispenser for medications having no particular appeal to patients but which must be taken diligently.

DETAILED DESCRIPTION OF THE INVENTION

The Totally Interactive Patient Compliance Program

The present invention relates to a Totally Interactive Patient Compliance Program (Compliance Program) designed to encourage compliance, provide cost effective interaction between patients and physicians, and improve health care output while reducing net cost. The Compliance Program is a novel approach designed to solve most traditional problems related to compliance as well as at new features consistent with an increasingly cost sensitive health care system. The invention also relates to Medication Compliance Dispensers for use in conjunction with the Totally Interactive Patient Compliance Program.

As set out in FIG. 1, the Totally Interactive Patient Compliance Program involves the prescribing physician, an enrolled and trained pharmacist, the active involvement of the patient, and an ad-hoc creation of a Totally Interactive Patient Compliance Program Center. The process starts with the physician prescribing a traditional prescription but with the addendum that it is part of the Compliance Program. The patient takes this prescription to the pharmacist who, in turn, dispenses a dedicated Medication Compliance Dispenser or Compliance Program card and logs that patient as well as the Medication Compliance Dispenser in with the Compliance Center (and informs the physician as to the patient number).

In one embodiment, the Compliance Program is designed to help prevent drug abuse by a patient taking medicine. In this embodiment, the Medication Compliance Dispenser comprises a multicompartment container wherein some of the compartments in the Medication Compliance Dispenser contain individual doses of the medicine and some of the compartments contain a placebo. Each compartment is labeled with a code to identify the compartment. When the patient wishes medication, he accesses a number, such as a toll free number, for the Totally Interactive Patient Compliance Program Center. The patient identifies himself only by patient number and, based upon the prescription regime entered into the Compliance Program Center software by the pharmacist (on behalf of the prescribing physician), the patient is granted medication or not. For example, the patient might be permitted to take a pain pill no more than one every four hours. Or, in the case of a sleep aid medication, he might be permitted to have no more than six per month. Without contacting the Totally Interactive Patient Compliance Program Center, the patient has no way of knowing which pills are real and which are placebos. The Compliance Program Center systematically indicates to the patient which he or she may use—in specific accordance with the software directed by the prescribing physician. These disciplined events are also the occasion for asking any relevant questions of the patient.

In another embodiment, the Compliance Program is designed to help a patient comply with taking a medicine. In this embodiment, the compartments in the Medication Compliance Dispenser contain individual doses of the medicine presented in numerical sequence (all real). Beneath some of this medicine, on a basis unknown to the patient is a hidden mark (such as a "blue dot"). When this mark appears, the patient is instructed to phone the Compliance Center. Since the randomization of these dots is known only to the Center and the prescription has been logged in, the Center is well aware of when the patients are supposed to call. If a patient proceeds more than an agreed to amount of time without calling in, then the Center will notify either the physician or go through a process of reminding the patient on an agreed to basis.

The Compliance Program Center is also equipped to ask questions about the patient's condition. These can include questions about the patient's weight, appetite, pain, sleeplessness, etc. Since it is likely that the Center will be computerized, all of these questions may be programmed in such a way as to be answerable on a "yes" or "no" basis or on a numerical scale (e.g., 1–5).

In addition to having patient responses, the Compliance Program Center, of course, is able to log both the time and the amount of medication requested by patients. This information is then made available to the physician treating the patient. Such data can serve the purpose of demonstrating the management of a disease (e.g., using less and less pain medication) or may demonstrate important insights into medication requirement patterns (particular times of day, every Monday morning, relating to a woman's periodic cycle, etc.)

The Totally Interactive Patient Compliance Program Card

An important aspect of the Totally Interactive Patient Compliance Program is a specifically designed Medication Compliance Dispenser comprising a multicompartment container (FIGS. 2 and 3). This multicompartment container may have any number of configurations of blister packaging (or any other form of unit dosing).

In one embodiment, the Medication Compliance Dispenser is designed to help prevent drug abuse by a patient taking medicine (FIG. 2). These medicines would include the very large category of analgesics or pain killers as well as sleep aids and other "feel good" types of drugs. In this embodiment, at least some of the compartments contain individual doses of the medicine and at least some of the compartments contain an identical looking placebo. The contents of the compartments are designed on a basis that is randomized to the patient (but known by virtue of the specific card identification to the Totally Interactive Patient Compliance Program Center). Each compartment is labeled with a code to identify the compartment, (letter, number code, etc.). The container is designed to permit random access to each compartment and the dispensing of its contents. The Dispenser displays a telephone number which the patient must call to learn the code of a compartment which contains the medicine.

In another embodiment, the Medication Compliance Dispenser is designed to help a patient comply with taking a medicine (FIG. 3). These medicines would include the very large category of medicines that have no particular appeal to patients but are equally important that they be take diligently. In this embodiment, the compartments contain individual doses of the medicine presented in numerical sequence (all real). The container has means permitting sequential access to each compartment and dispensing of its contents. Upon a medicine being dispensed from a compartment, at least some of the compartments display a message to the patient to phone the Compliance Center. Since the randomization of these dots is known only to the Center and the prescription has been logged in, the Center is well aware of when the patients are supposed to call.

In a preferred embodiment, the individual doses of medicine may be removed from the top of the compartments leaving the bottom display panel intact.

The invention being thus described, it will be obvious that the same may be varied in many ways. Such variations are not to be regarded as a departure from the spirit and scope of the invention and all such modifications are intended to be included within the scope of the following claims.

We claim:

1. A method for helping prevent drug abuse by a patient taking medicine in a totally interactive patient compliance Program which comprises the steps of:

(A) providing a patient with a medication compliance dispenser having a multicompartment container wherein:

(a) at least some of the compartments contain individual doses of medicine and at least some of the compartments contain a placebo;

(b) the compartments containing the medicine are randomly arranged;

(c) each compartment is labeled with a code to identify the compartment;

(d) the container has means permitting random access to each compartment and the dispensing of its contents; and (e) the dispenser displays a telephone number which the patient must call to learn the code of a compartment which contains the medicine; and (B) instructing the patient to call the telephone number to learn the code of a compartment which contains the medicine in order to take the medicine.

2. The method according to claim 1, wherein the container has means permitting dispensing of its contents maintaining code labeling of each compartment intact.

* * * * *